US008646658B2

(12) United States Patent
Bae

(10) Patent No.: US 8,646,658 B2
(45) Date of Patent: Feb. 11, 2014

(54) COSMETIC RECEPTACLE

(75) Inventor: Hae Dong Bae, Anyang (KR)

(73) Assignee: Taesung Industrial Co., Ltd., Anyang, Kyungki-do (KR)

( * ) Notice: Subject to any disclaimer, the term of this patent is extended or adjusted under 35 U.S.C. 154(b) by 11 days.

(21) Appl. No.: 13/555,916

(22) Filed: Jul. 23, 2012

(65) Prior Publication Data

US 2013/0146618 A1 Jun. 13, 2013

(30) Foreign Application Priority Data

Dec. 7, 2011 (KR) ..... 20-2011-0010855 U

(51) Int. Cl.
*B67D 7/06* (2010.01)

(52) U.S. Cl.
USPC ..... 222/182; 222/183; 222/212; 251/7

(58) Field of Classification Search
USPC ..... 222/183, 182, 212, 206, 215, 209, 213; 251/4, 7, 9, 10
See application file for complete search history.

(56) References Cited

U.S. PATENT DOCUMENTS

| | | | | |
|---|---|---|---|---|
| 2,197,995 | A * | 4/1940 | Crowley | 251/7 |
| 4,776,495 | A * | 10/1988 | Vignot | 222/207 |
| 8,336,790 | B2 * | 12/2012 | Kolins | 239/327 |
| 2004/0149778 | A1 * | 8/2004 | Altonen et al. | 222/212 |
| 2008/0029548 | A1 * | 2/2008 | De Wree et al. | 222/212 |
| 2012/0097710 | A1 * | 4/2012 | Ahmer | 222/212 |
| 2012/0267397 | A1 * | 10/2012 | Inaba et al. | 222/209 |

* cited by examiner

*Primary Examiner* — Kevin P Shaver
*Assistant Examiner* — Michael J Melaragno
(74) *Attorney, Agent, or Firm* — Lowe Hauptman & Ham, LLP

(57) ABSTRACT

A cosmetic receptacle includes a storage container having a storage container body and a pipe-shaped neck, an inner cap having a pair of operation protrusion exposure openings, a discharge operation part for discharging cosmetics stored in the storage and having a nozzle, a nozzle opening/closing valve having a pair of opening/closing operation protrusions and a pair of press plates, an outer cap coupled to the inner cap such that the pair of opening/closing operation protrusions protruding through the operation protrusion exposure openings is pressurized in a direction in which they approach each other, a shoulder part having a support plate and a skirt part, and a concave auxiliary container having a pair of button openings.

3 Claims, 13 Drawing Sheets

COSMETIC RECEPTACLE

CROSS REFERENCE TO RELATED APPLICATION

This application claims the priority of Korean Utility Model Application No. 20-2011-0010855 filed on Dec. 7, 2011 in the KIPO (Korea Intellectual Property Office), the disclosure of which is incorporated herein in their entirety by reference.

BACKGROUND OF THE INVENTION

1. Field of the Invention

The present invention relates to a cosmetic receptacle, and more particularly to a cosmetic receptacle for discharging cosmetics stored in the cosmetic receptacle little by little through manipulation of a discharge operation button.

2. Description of the Prior Art

A cosmetic receptacle for storing a liquid type of cosmetics, such as a lotion and an essence, and discharging the stored cosmetics little by little through manipulation of a discharge operation button has been conceived and used. The liquid used herein includes a material, such as cream, having viscosity to the extent of being pumped.

FIG. 14 is an exploded perspective view illustrating a conventional cosmetic receptacle and FIG. 15 is a sectional view illustrating the coupled conventional cosmetic receptacle.

As illustrated in FIGS. 14 and 15, the conventional cosmetic receptacle includes a storage container 110 having a storage container body 111 in which a storage space 111*a* is formed, an inner cap 120 detachably coupled to the storage container 110, a shoulder part 160 and an auxiliary container 153 mounted to the storage container 110, an outer cap 154 enclosing the inner cap 120, and a discharge operation part 170 for discharging cosmetics stored in the storage space 111*a* to the outside through the interworking with an external operation.

The storage container 110 is provided with a pipe-shaped neck part 112 formed at the storage container body 111 such that the neck part 112 is connected to the storage space 111*a*, in addition to the storage container body 111.

The inner cap 120 includes an inner cap body 121 through which an inner cap through-opening 121*a* passes and a closed-loop shaped inner cap circumferential wall 122 extending from the inner cap body 121 such that the closed-loop shaped inner cap circumferential wall 122 surrounds the inner cap through-opening 121*a*.

The inner cap 120 having the aforementioned construction is detachably coupled to the neck part 112 through the inner cap body 121 such that the inner cap through-opening 121*a* is connected to the neck part 112.

The shoulder part 160 includes a support pipe part 161 in which a neck passage opening 161*a* is formed at a center thereof, an inner-skirt part 162 extending from an upper end of the support pipe part 161, and an outer-skirt part 163 extending from an outside surface of the inner-skirt part 162.

The outer-skirt part 163 includes a plurality of seating protrusions 163*a* at an outside surface thereof.

The shoulder part 160 having the aforementioned construction is mounted such that the neck part 112 passes through the neck passage opening 161*a* in a lower side of the inner cap 120 and the shoulder part 160 is supported on the storage container body 111 through the support pipe part 161.

The auxiliary container 153 is installed such that an upper end of the auxiliary container 153 enters between the inner-skirt part 162 and the outer-skirt part 163. Accordingly, the auxiliary container 153 surrounds the storage container body 111.

The outer cap 154 includes seating recesses corresponding to the seating protrusions 163*a* (not shown) in an inside surface thereof.

The outer cap 154 having the aforementioned construction is mounted such that the seating protrusions 163 are seated in the seating grooves (not shown), an inside surface of the outer cap 154 is in contact with an outside surface of the support pipe part 161, and the outer cap 154 surrounds the inner cap 120.

The discharge operation part 170 includes a cylinder 171 installed such that the cylinder 171 is supported on an upper end of the neck part 112 in a lower side of the inner cap 120, a coil-shaped button returning spring 174 mounted such that a lower end of the button returning spring 174 is supported on the inner cap 120, a discharge operation button 172 installed such that the discharge operation button 172 is supported on an upper end of the button returning spring 174, a nozzle 173 mounted to the discharge operation button 172, an operation pipe 175 coupled to the discharge operation button 172 such that the operation pipe 175 may move down together with the discharge operation button 172 when the discharge operation button 172 is pressurized, an operation shaft 176 installed inside the operation pipe 175 such that the operation shaft 176 may move down together with the operation pipe 175 when the operation pipe 175 moves down, a closed-loop shaped cylinder piston 177 mounted such that the cylinder piston 177 is in close contact with an inner wall surface of the cylinder 171 in a circumferential region of the operation shaft 176, a cylinder opening/closing valve 178 installed in a bottom surface of the cylinder 171, and a container piston 179 installed in a lower side of the inner space of the storage container body 111.

The cylinder 171 has an introduction opening 171*a* in a lower surface thereof and an opening part in an upper surface thereof.

The cylinder 171 having the aforementioned construction is mounted such that the opening part in the upper surface of the cylinder 171 is connected with the inner cap through-opening 121*a*.

The discharge operation button 172 is provided with a button flow path 172*a* connected to the operation pipe 175.

A nozzle 173 is provided with a nozzle flow path 173*a* in an inner side thereof.

The nozzle 173 having the aforementioned construction is mounted to the discharge operation button 172 such that the nozzle flow path 173*a* is connected to the button flow path 172*a*.

The discharge operation button 172 and the nozzle 173 are made of hard synthetic resins, such as polypropylene (PP).

The operation pipe 175 has a lengthwise section such that a lower end of the operation pipe 175 may enter an inside of the cylinder 171.

The operation shaft 176 has a lengthwise section allowing a lower end of the operation shaft 176 to enter the inside of the cylinder 171 more deeply than the operation pipe 175, and guide protrusions 176*a* are dispersed in an outside surface adjacent to the lower end thereof.

The cylinder piston 177 has a shaft passage opening 177*a* at a central region thereof.

The cylinder piston 177 having the aforementioned construction is installed in the inside of the cylinder 171 such that an outside surface of the cylinder piston 177 is in close contact with an inner surface of the cylinder 171 and the operation shaft 176 passes through the shaft passage opening 177*a*.

The cylinder opening/closing valve 178 is shaped like a ball and is installed in a bottom surface of the cylinder 171 so as to close the introduction opening 171*a*.

The container piston 179 is installed such that an outer surface of the container piston 179 is in close contact with an inner surface of the storage container body 111. Accordingly, the container piston 179 tightly closes a lower-side opening of the storage container body 111.

Hereinafter, an operation of the conventional cosmetic receptacle having the above construction will be described. For convenience of the description, it is assumed that cosmetics are stored in an inside of the cylinder 171 and the storage space 111*a*.

First, the outer cap 154 is separated from the shoulder part 160.

Next, when the discharge operation button 172 is pressurized toward the inner cap 120, the operation pipe 175 and the operation shaft 176 move down and elastic force is accumulated in the button returning spring 174.

When the operation shaft 176 moves down, a cosmetic flow path is formed between an inner circumferential surface of the shaft passage opening 177*a* and an outer surface of the operation shaft 176.

When the cosmetic flow path is formed between the inner circumferential surface of the shaft passage opening 177*a* and the outer surface of the operation shaft 176 as described above, the cosmetics contained in the inside of the cylinder 171 sequentially passes the operation pipe 175, the button flow path 172*a*, and the nozzle flow path 173, to be discharged to the outside.

In the meantime, when the operation of pressing the discharge operation button 172 is released, the operation shaft 176, the operation pipe 175, and the discharge operation button 172 move up by the elastic force accumulated in the button returning spring 174.

When the operation shaft 176 moves up, the cosmetic flow path formed between the inner circumferential surface of the shaft passage opening 177*a* and the outer surface of the operation shaft 176 disappears and negative pressure is generated in the inside of the cylinder 171.

When the negative pressure is generated in the inside of the cylinder 171, the cylinder opening/closing valve 178 moves up so that the introduction opening 171*a* is opened, and the cosmetic flow path is formed between the cylinder 171 and the storage container body 111.

When the cosmetic flow path is formed between the cylinder 171 and the storage container body 111, the cosmetics stored in the storage container body 111 flows to the inside of the cylinder 171.

When the cosmetics stored in the storage container body 111 flow to the inside of the cylinder 171, the container piston 179 moves toward the inner cap 120 while being in close contact with the inner surface of the storage container body 111.

However, according to the conventional cosmetic receptacle, since the nozzle 173 is amounted to the discharge operation button 172 disposed in the upper side of the inner cap 120, a cosmetic discharge route (the operation pipe and the button flow path) between the nozzle 173 and the storage container body 111 becomes long, thereby causing a problem of the unsmooth discharge of the cosmetics. Such a problem becomes serious as the viscosity of the cosmetics stored in the storage space 111*a* is high.

Further, since the nozzle flow path 173*a* is maintained in an opened state during the not-discharge of the cosmetics, the cosmetics left in the operation pipe 175 and the button flow path 172*a* are solidified, thereby failing to smoothly discharge the cosmetics.

Further, since the nozzle flow path 173*a* is maintained in an opened state during the not-discharge of the cosmetics, the cosmetics left in the operation pipe 175 and the button flow path 172*a* are spoiled, thereby creating concerns of skin problems.

SUMMARY OF THE INVENTION

Accordingly, the present invention has been made to solve the above-mentioned problems occurring in the prior art, and the present invention provides a cosmetic receptacle capable of decreasing a cosmetic discharge route between a nozzle and a storage container body and closing the nozzle during non-discharge of the cosmetics.

In accordance with an aspect of the present invention, there is provided a cosmetic receptacle including: a storage container including a storage container body having a storage space therein and a pipe-shaped neck part formed in the storage container body such that the neck part is connected to the storage space; an inner cap configured to include an inner cap body through which an inner cap through-opening passes and a closed-loop shaped inner cap circumferential wall extending from the inner cap body to surround the inner cap through-opening, and detachably coupled to the storage container through the inner cap body such that the inner cap through-opening is connected to the neck part; a discharge operation part for discharging cosmetics stored in the storage space through a nozzle flow path with interworking with manipulation of discharge operation buttons, the discharge operation part including a nozzle provided with the nozzle flow path and installed such that the nozzle flow path is connected to the neck part and the discharge operation buttons manipulated by a user when the user desires to discharge the cosmetics stored in the storage space through the nozzle flow path; an outer cap installed such that the outer cap surrounds the inner cap; a shoulder part configured to include a support plate provided with a neck passage opening at a center thereof and a skirt part bent from a circumferential portion of the support plate and installed such that the neck part passes through the neck passage opening in a lower region of the inner cap and the shoulder part is supported on the storage container body through the support plate; and a concave auxiliary container including a pair of button openings having a phase difference of 180° and mounted to the storage container such that the auxiliary container surrounds the storage container body, wherein the inner cap circumferential wall has a pair of operation protrusion exposure openings having a phase difference of 180°, the nozzle is made of an elastic material, has a concave lever-pressurized surface in an outer surface of the nozzle to surround the nozzle flow path, and is installed in the inner cap through-opening such that the lever-pressurized surface faces the operation protrusion exposure opening, the discharge operation part includes a nozzle opening/closing valve and a pair of press plates, the nozzle opening/closing valve including a ring-shaped valve body, a pair of opening/closing operation levers having a phase difference of 180° and extending from an inner surface of the valve body in a direction in which they approach each other, and a pair of opening/closing operation protrusions extending from an outside surface of the valve body at identical positions of the opening/closing operation levers in a direction in which they are away from each other, the nozzle opening/closing valve being installed in the inner cap such that the opening/closing operation protrusions protrude through the operation protrusion exposure opening, the valve body is deformed when the pair of opening/closing operation protrusions approach each other, and when the valve body is deformed, the pair of opening/closing operation levers press the lever-pressurized surface in both directions until the nozzle flow path is closed, the pair of press plates being formed from the skirt part to reach the button openings, the outer cap is coupled to the inner cap such that the pair of opening/closing operation protrusions protruding through the operation protrusion exposure openings is pressurized in a direction in which they approach each other, and the discharge operation buttons protrude from outer surfaces of the press plates such that the discharge operation buttons enter the button openings.

Preferably, each opening/closing operation lever has a longitudinal section shaped like a concave circular arc, such that the nozzle flow path is stably closed when the outer cap is coupled to the inner cap.

Preferably, the nozzle includes a pair of latching jaws disposed in parallel in an outside surface of the nozzle with the lever-pressurized surface placed between the latching jaws and shaped like a closed-loop, such that the opening/closing levers may stably press the lever-pressurized surface in both directions.

According to the present invention, the nozzle opening/closing valve, which is operated such that the nozzle flow path is closed when the outer cap is coupled to the inner cap and the nozzle flow path is opened when the outer cap is separated from the inner cap, is installed in the inner cap, and the discharge operation buttons are formed in the circumferential region of the storage container body, so that it is possible to decrease the cosmetic discharge route between the nozzle and the storage container body and close the nozzle during the non-discharge of the cosmetics.

DETAILED DESCRIPTION OF THE EXEMPLARY EMBODIMENTS

Hereinafter, the present invention will be described with reference to the accompanying drawings.

Figure 1:
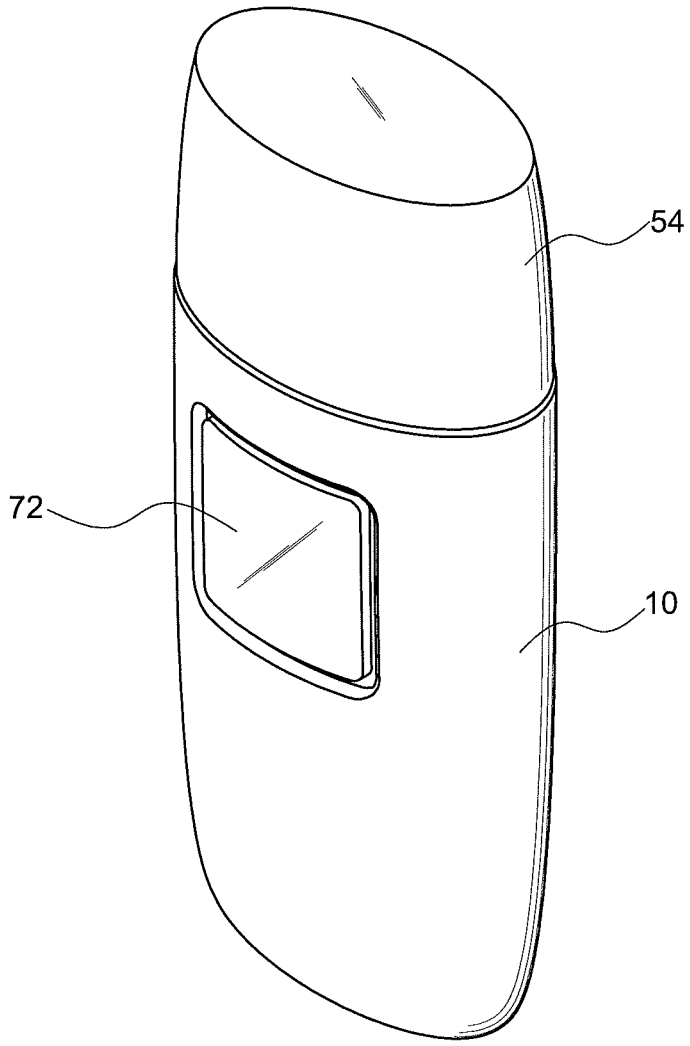
FIG. 1 is a perspective view illustrating a coupled cosmetic receptacle according to an embodiment of the present invention.
Figure 2:
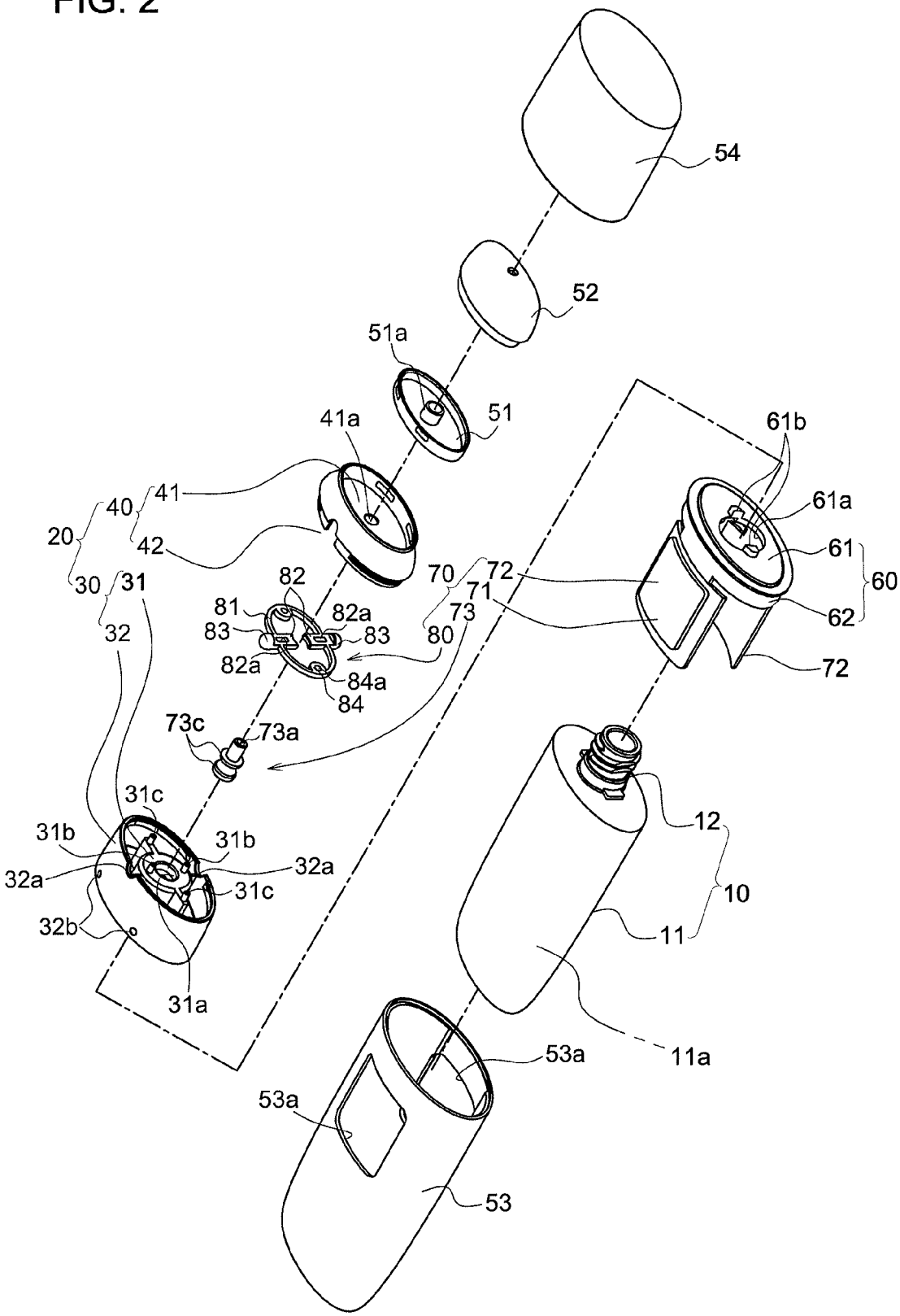
FIG. 2 is an exploded perspective view illustrating a cosmetic receptacle according to an embodiment of the present invention.
Figure 3:
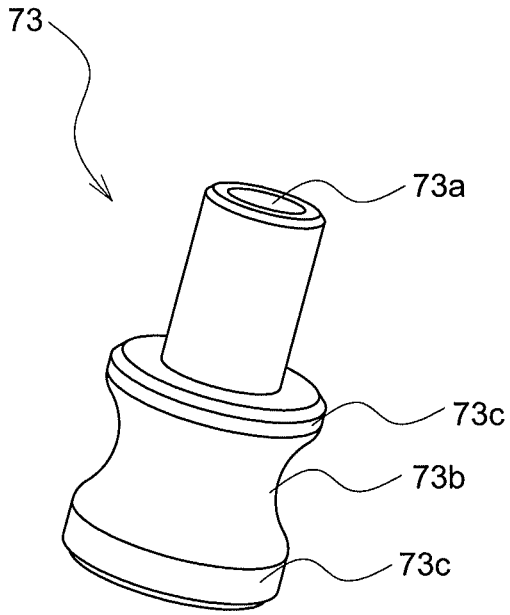
FIG. 3 is a perspective view illustrating a nozzle illustrated in FIG. 2.
Figure 4:
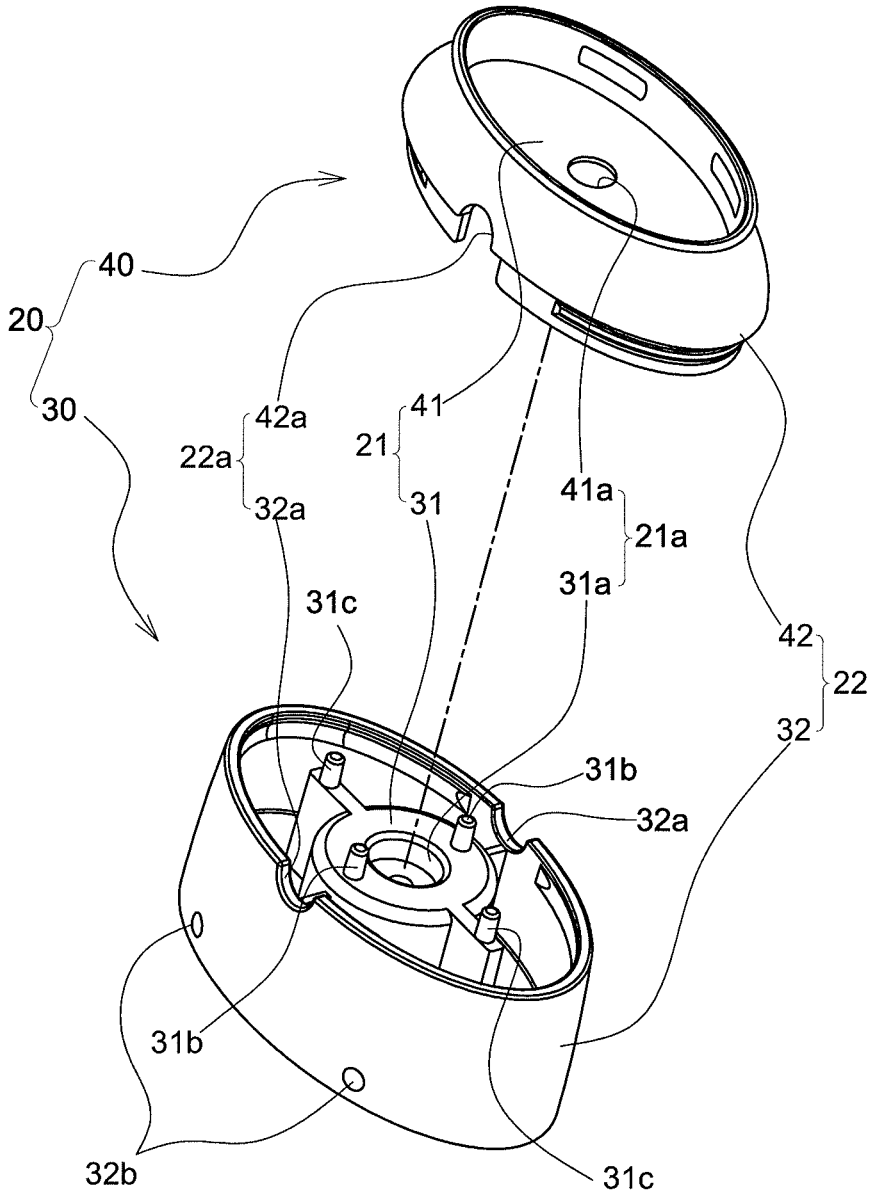
FIG. 4 is an exploded perspective view illustrating an inner cap illustrated in FIG. 2.
Figure 5:
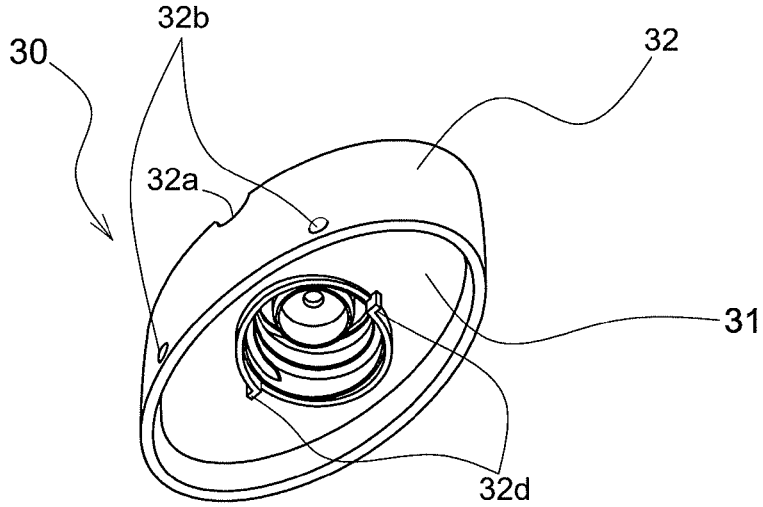
FIG. 5 is a perspective view illustrating a lower-side inner cap illustrated in FIG. 2.
Figure 6:
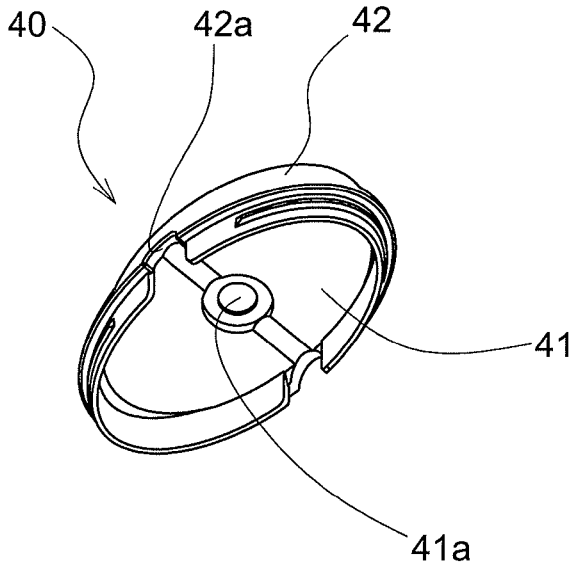
FIG. 6 is a perspective view illustrating an upper-side inner cap illustrated in FIG. 2.
Figure 7:
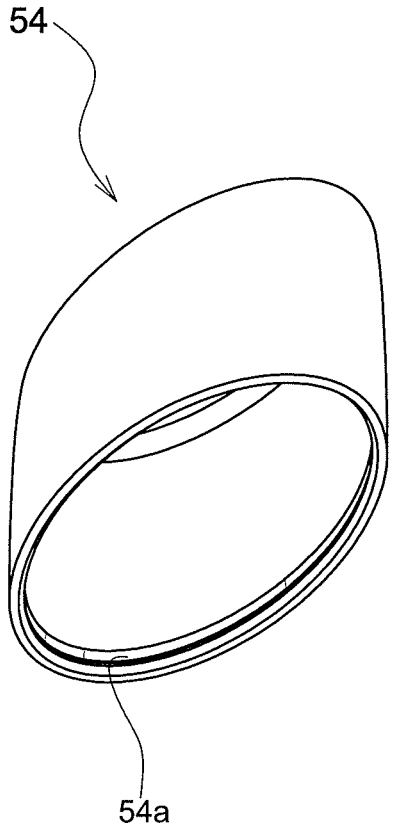
FIG. 7 is a perspective view illustrating an outer cap illustrated in FIG. 2.
Figure 8:
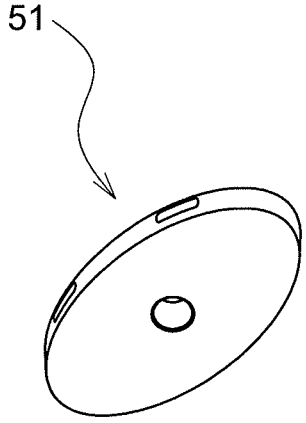
FIG. 8 is a perspective view illustrating a puff holder illustrated in FIG. 2.
Figure 9:
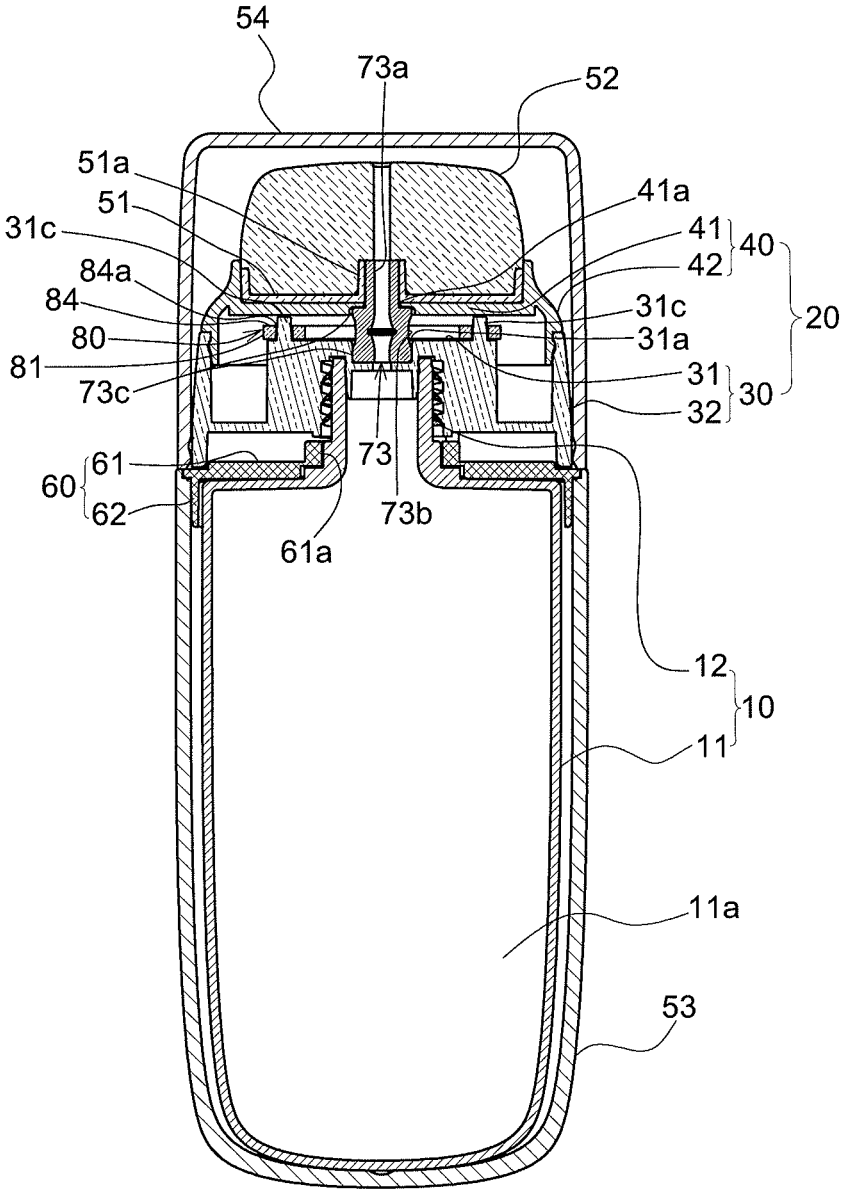
FIGS. 9 and 10 are sectional views illustrating a coupled cosmetic receptacle according to an embodiment of the present invention, respectively.
Figure 10:
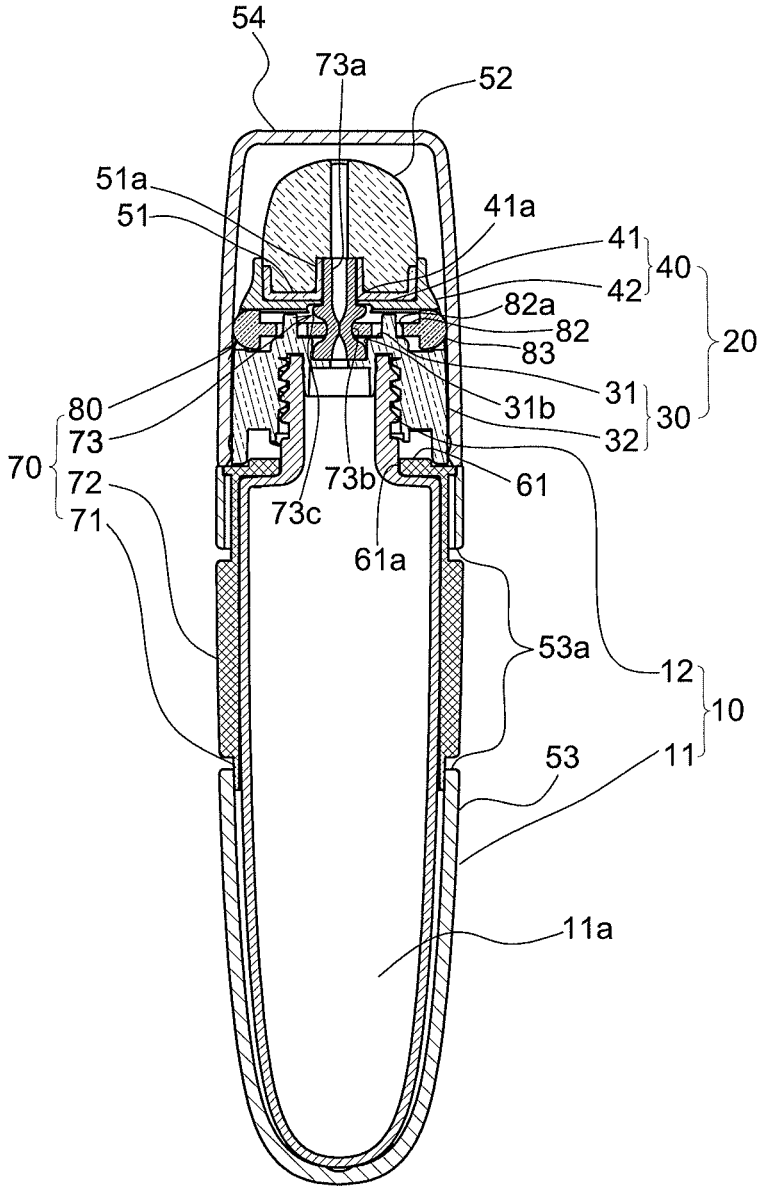
Figure 11:
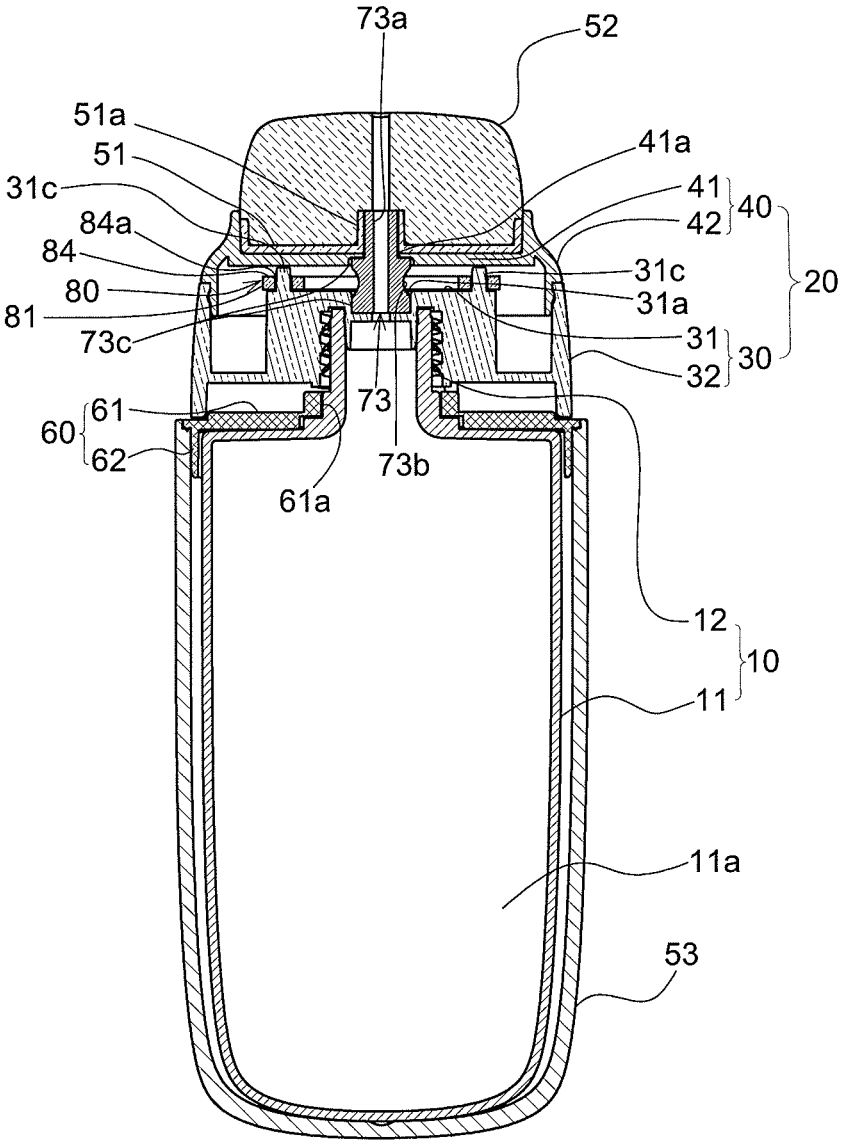
FIGS. 11 and 12 are sectional views illustrating a cosmetic receptacle in a state of an outer cap being separated according to an embodiment of the present invention, respectively.
Figure 12:
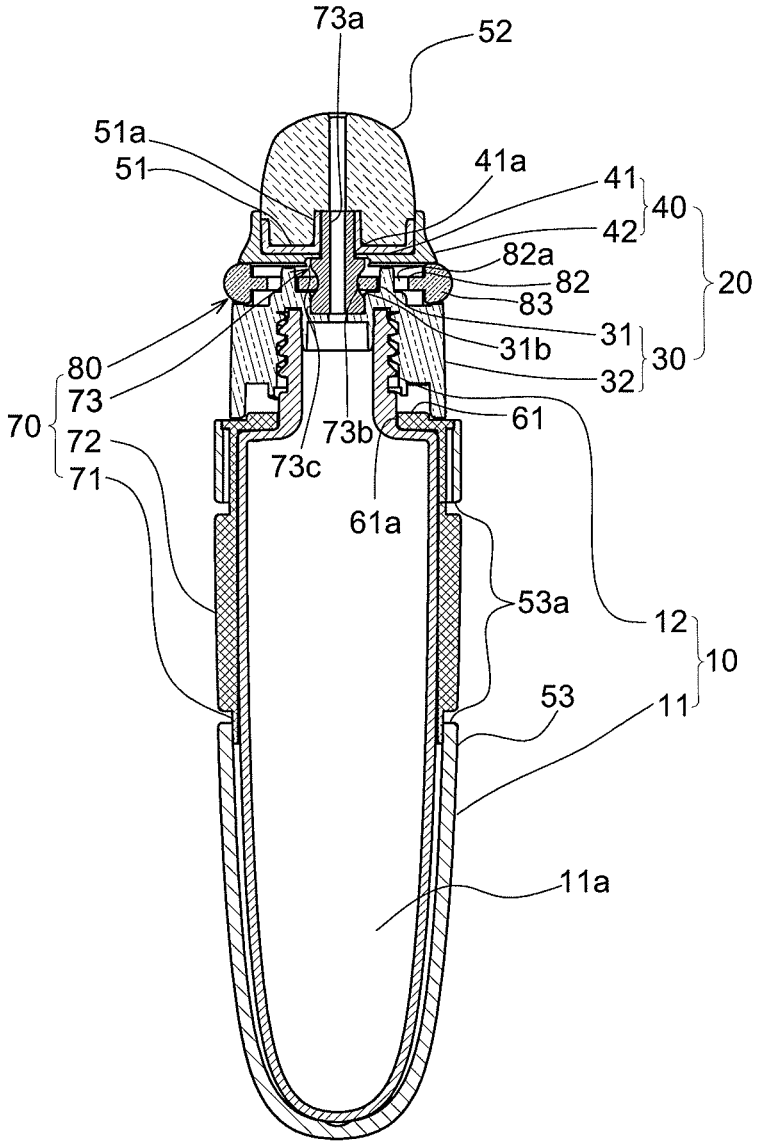

FIG. 1 is a coupled perspective view illustrating a cosmetic receptacle according to an embodiment of the present invention, FIG. 2 is an exploded perspective view illustrating a cosmetic receptacle according to an embodiment of the present invention, FIG. 3 is a perspective view illustrating a nozzle illustrated in FIG. 2, FIG. 4 is an exploded perspective view illustrating an inner cap illustrated in FIG. 2, FIG. 5 is a perspective view illustrating a lower-side inner cap illustrated in FIG. 2, FIG. 6 is a perspective view illustrating an upper-side inner cap illustrated in FIG. 2, FIG. 7 is a perspective view illustrating an outer cap illustrated in FIG. 2, FIG. 8 is a perspective view illustrating a puff holder illustrated in FIG. 2, FIGS. 9 and 10 are sectional views illustrating a coupled cosmetic receptacle according to an embodiment of the present invention, respectively, and FIGS. 11 and 12 are sectional views illustrating a cosmetic receptacle in a state of an outer cap being separated according to an embodiment of the present invention, respectively.

As illustrated in FIGS. 1 to 12, the cosmetic receptacle according to the embodiment of the present invention includes a storage container 10 including a storage container body 11 having a storage space 11*a* therein, an inner cap 20 detachably coupled to the storage container 10, a puff holder 51 mounted to the inner cap 20, a puff 52 mounted to the puff holder 51, a shoulder part 60 and an auxiliary container 53 mounted to the storage container 10, an outer cap 54 surrounding the inner cap 20, and a discharge operation part 70 for discharging cosmetics stored in the storage space 11*a* to the outside through the interworking with an external operation.

The storage container 10 has a pipe-shaped neck part 12 formed in the storage container body 11 such that the neck part 12 is connected to the storage space 11*a* in addition to the storage container body 11.

The inner cap 20 is divided into a lower-side inner cap 30 and an upper-side inner cap 40.

The lower-side inner cap 30 includes a lower-side inner cap body 31 through which a lower-side inner cap through-opening 31*a* passes and a closed-loop shaped lower-side inner cap circumferential wall 32 extending from the lower-side inner cap body 31 such that the closed-loop shaped lower-side inner cap circumferential wall 32 surrounds the lower-side inner cap through-opening 31*a*.

The lower-side inner cap body 31 includes a pair of valve guide pillars 31*b* having a phase difference of 180° in an upper surface thereof.

The lower-side inner cap body 31 includes a pair of valve support pillars 31*b* having a phase difference of 180° in the upper surface thereof.

The lower-side inner cap circumferential wall 32 includes a pair of lower operation protrusion exposure grooves 32*a* having a phase difference of 180° in an upper end thereof and a plurality of seating protrusions 32*b* in an outside surface thereof.

The upper-side inner cap 40 includes an upper-side inner cap body 41 through which an upper-side inner cap through-opening 41*a* passes and a closed-loop shaped upper-side inner cap circumferential wall 42 extending from the upper-side inner cap body 41 such that the closed-loop shaped upper-side inner cap circumferential wall 42 surrounds the upper-side inner cap through-opening 41*a*.

The upper-side inner cap circumferential wall 42 includes a pair of upper operation protrusion exposure grooves 42*a* having a phase difference of 180° in a lower end thereof.

The upper-side inner cap 40 having the aforementioned construction is undercut coupled to the lower-side inner cap circumferential wall through the upper-side inner cap circumferential wall 42.

In a state where the upper-side inner cap 40 is coupled to the lower-side inner cap 30, the lower-side inner cap body 31 and the upper-side inner cap body 41 form an inner cap body 21, the lower-side inner cap circumferential wall 32 and the upper-side inner cap circumferential wall 42 form an inner cap circumferential wall 22, the lower operation protrusion exposure groove 32*a* and the upper operation protrusion exposure groove 42*a* form an operation protrusion exposure opening 22*a*, and the lower-side inner cap through-opening 31*a* and the upper-side inner cap through-opening 41*a* form an inner cap through opening 21*a*.

The inner cap 20 having the aforementioned construction is detachably coupled to the storage container 10 through the lower-side inner cap body 31 such that the inner cap through-opening 21*a* is connected to the neck part 12.

The puff holder 51 includes a nozzle support pipe 51*a* in an upper surface thereof.

The puff holder 51 having the aforementioned construction is undercut coupled to the upper-side inner cap circumferential wall 42 such that the nozzle support pipe 51*a* is connected to the inner cap through-opening 21*a*.

The shoulder part 60 includes a support plate 61 provided with a neck passage opening 61*a* at a center thereof and a skirt part 62 bent from a circumferential region of the support plate 61.

The support plate 61 has a pair of arrangement protrusions 61*b* in a circumferential region of the neck passage opening 61*a* in an upper surface thereof.

The shoulder part 60 having the aforementioned construction is installed such that the neck part 12 passes through the neck passage opening 61*a* in a lower region of the inner cap 20 and the shoulder part 60 is supported on the storage container body 11 through the support plate 61.

The auxiliary container 53 has a concave shape and includes a pair of button openings 53*a* having a phase difference of 180°.

The auxiliary container 53 having the aforementioned construction is installed such that an upper end of the auxiliary container 53 is in contact with a lower surface of the support plate 61. Accordingly, the auxiliary container 53 surrounds the storage container body 11.

The outer cap 54 has a ring-shaped seating groove 54*a* in an inner surface thereof.

The outer cap 54 having the aforementioned construction is installed such that the seating protrusions 32*b* enters the seating groove 54*a* and an inner surface of the outer cap 54 is in contact with the outer surface of the lower-side inner cap circumferential wall 32 to surround the inner cap 20.

When the inner surface of the outer cap 54 is in contact with the outer surface of the lower-side inner cap circumferential wall 32, a pair of opening/closing operation protrusions 83 to be described later is pressurized in a direction in which they approach each other.

The discharge operation part 70 includes a pair of press plates 71 formed from the skirt part 62 to reach the button openings 53*a*, discharge operation buttons 72 formed in the press plates 71, and a nozzle 73 and a nozzle opening/closing valve 80 installed in the inner cap 20.

The discharge operation button 72 protrudes from an outside surface of the press plate 71 such that the discharge operation button 72 enters the button opening 53*a*.

The press plate 71 and the discharge operation button 72 may be integrally formed with the shoulder part 600 with a synthetic resin, such as PP, having a hardness property.

The nozzle 73 is made of an elastic material, such as acrylonitrile-butadiene rubber (NBR), and has a nozzle flow path 73*a*.

The nozzle 73 includes a lever-pressurized surface 73*b* having a concave shape and a pair of latching jaws 73*c* in an outside surface of the nozzle 73.

The lever-pressurized surface 73*b* surrounds the nozzle flow path 73*a*.

The pair of latching jaws 73*c* is disposed in parallel with the lever-pressurized surface 73*b* placed between the latching jaws 73*c* and shaped like a closed-loop, respectively.

The nozzle 73 having the aforementioned construction is installed in the inner cap through-opening 21*a* such that the nozzle flow path 73*a* is connected to the neck part 12 and the lever-pressurized surface 73*b* faces the operation protrusion exposure opening 22*a*.

The nozzle opening/closing valve 80 includes a ring-shaped valve body 81, a pair of opening/closing operation levers 82 and a pair of fixed flanges 84 extending from an inner surface of the valve body 81, and a pair of opening/closing operation protrusions 83 extending from an outside surface of the valve body 81.

The pair of opening/closing operation levers 82 extends from the inner surface of the valve body 81 having a phase difference of 180° in a direction in which they approach each other.

Each opening/closing operation lever 82 has a longitudinal section shaped like a concave circular arc, and is provided with a guide elongated hole 82*a* in a length direction.

Further, each opening/closing operation lever 82 has a lengthwise section capable of pressing the lever-pressurized surface 73*b* from both directions until the nozzle flow path 73*a* is closed during the deformation of the valve body 81.

Each fixing flange 84 is provided with a fixing hole 84*a*.

The pair of opening/closing operation protrusions 83 extends from the outside surface of the valve body 81 in a direction in which they are away from the same positions as that of the opening/closing operation levers 82.

The nozzle opening/closing valve 80 having the aforementioned construction is installed such that the opening/closing operation protrusion 83 protrudes through the operation protrusion exposure opening 22*a*, the valve body 81 is supported on the upper surface of the upper-side inner cap body 41, the valve guide pillar 31*b* passes through the guide elongated hole 82*a*, the valve support pillar 31*c* passes through the fixing hole 84*a*, and the pair of opening/closing operation levers 82*a* is in contact with or approaches the lever-pressurized surface 73*b*.

Accordingly, through the operation of coupling the outer cap 54 to the inner cap 20, the valve body 81 may be deformed when the pair of opening/closing operation protrusions 83 approaches each other, and when the valve body 81 is deformed, the pair of opening/closing operation levers 82 may pressurize the lever-pressurized surface 73*b* in both directions until the nozzle flow path 73*a* is closed.

When the valve body 81 is deformed, the elastic force is accumulated in the valve body part 81.

When the outer cap 54 is separated from the inner cap 20, each of the valve body part 81, the opening/closing operation levers 82, and the opening/closing operation protrusions 83 return to their original positions by the elastic force accumulated in the valve body part 81.

The deformation operation of the valve body 81 and the pressing operation of the opening/closing operation lever 82 are stably maintained by the valve guide pillar 31*b* and the guide elongated hole 82*a*.

The nozzle opening/closing valve 81 having the aforementioned construction may be made of a synthetic resin, such as polyacetal (POM).

Figure 13:
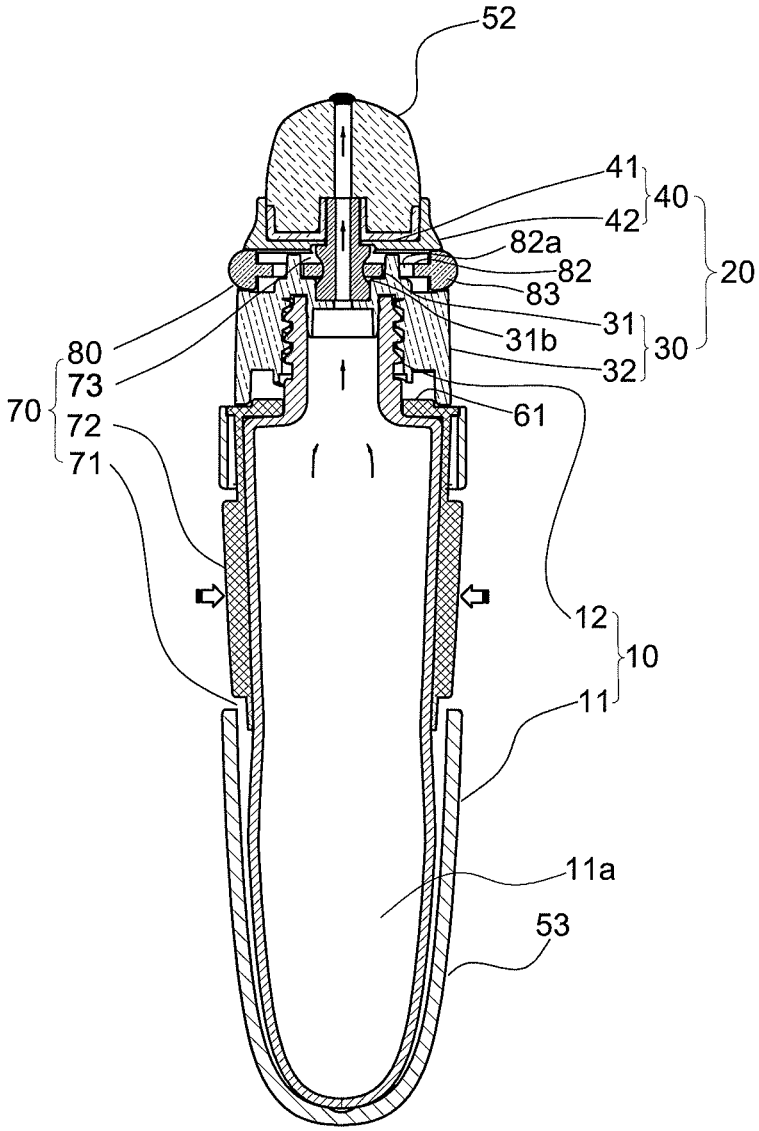
FIG. 13 is a state view illustrating an operation of a cosmetic receptacle according to an embodiment of the present invention.
Figure 14:
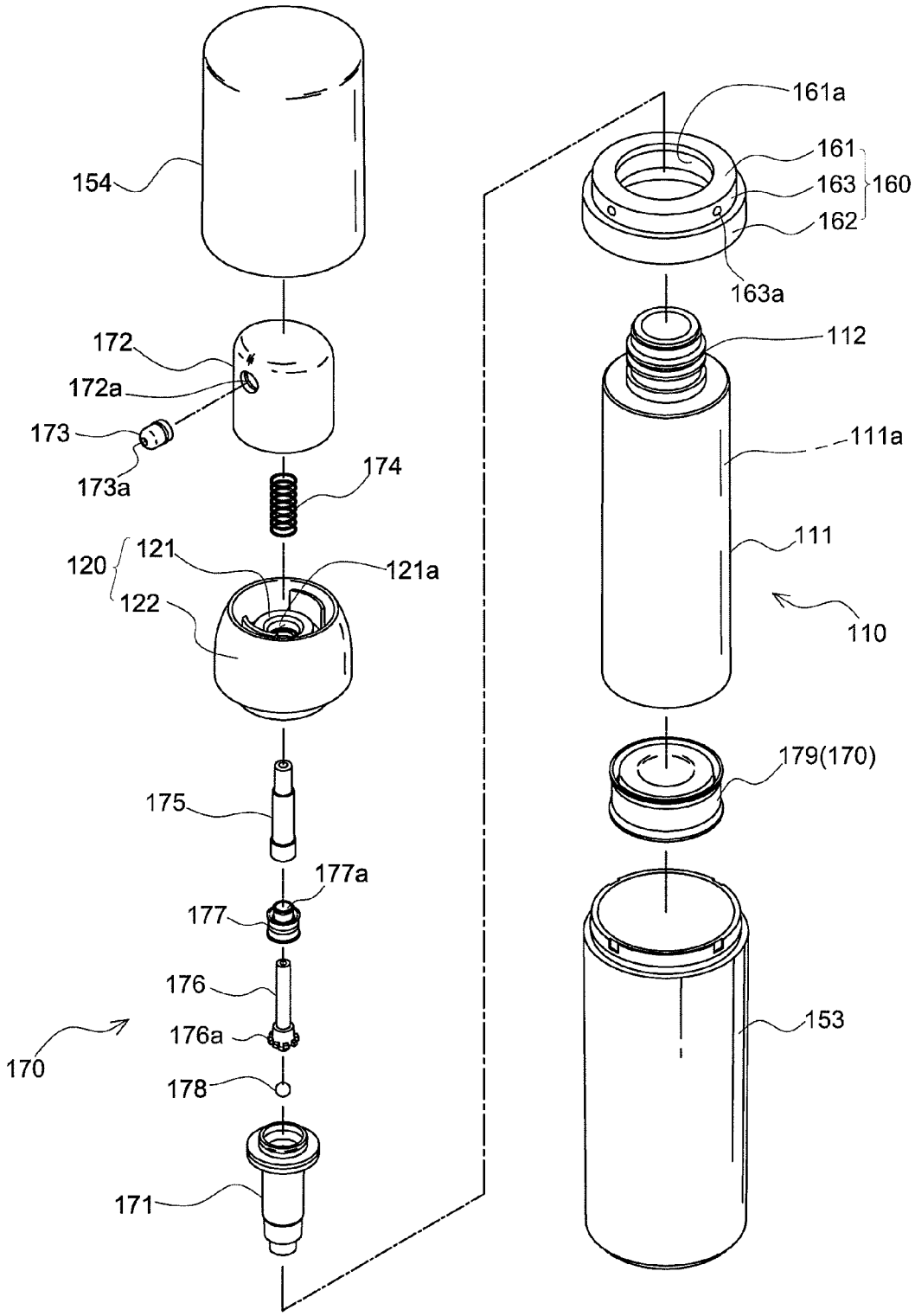
FIG. 14 PRIOR ART
FIG. 14 is an exploded perspective view illustrating a conventional cosmetic receptacle.
Figure 15:
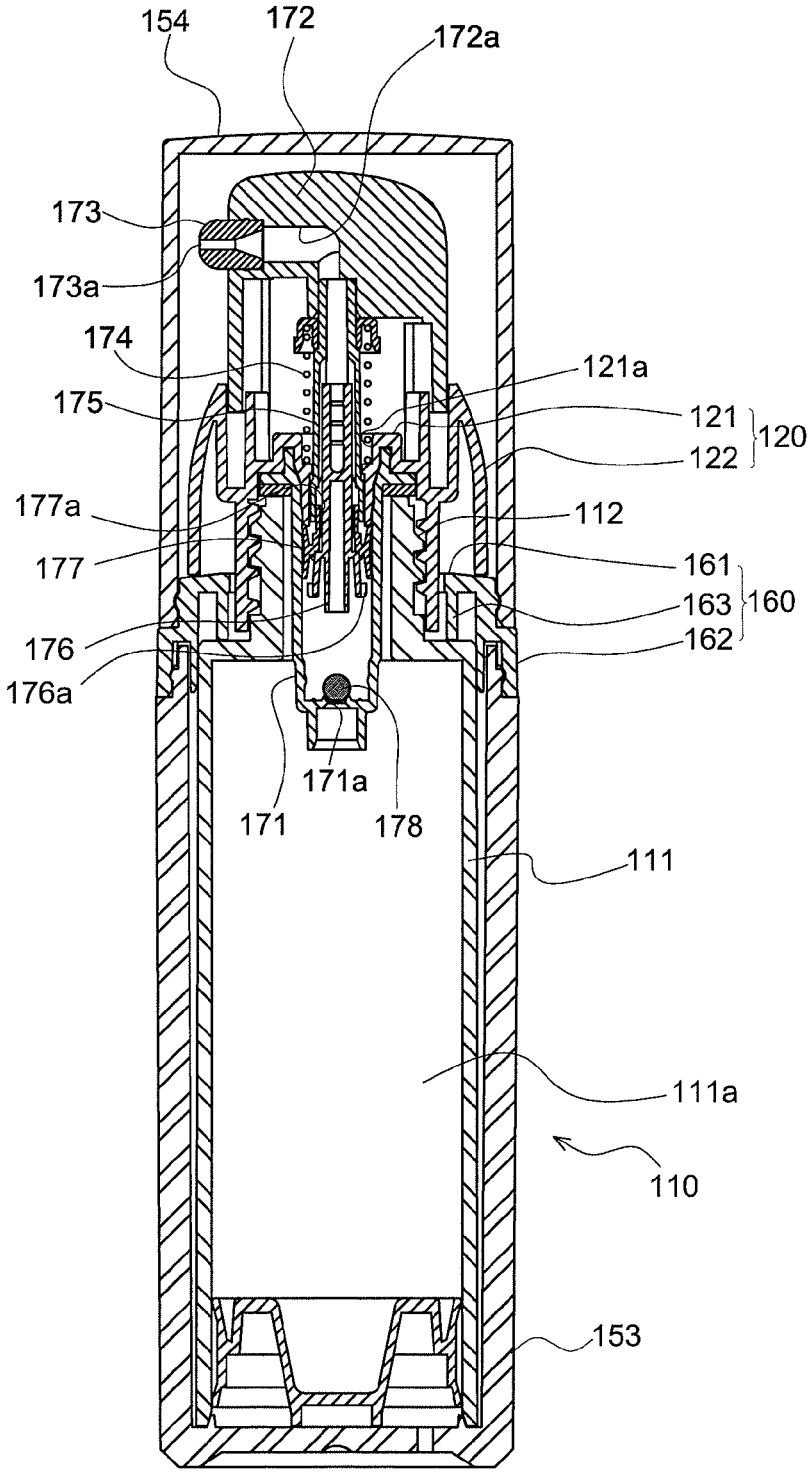
FIG. 15 PRIOR ART
FIG. 15 is a sectional view illustrating a coupled conventional cosmetic receptacle.

A method of using the cosmetic receptacle having the aforementioned construction according to the embodiment of the present invention will be described with reference to FIGS. 11, 12, and 13. It is assumed that the storage space 11*a* stores cosmetics.

First, the outer cap 54 is separated from the inner cap 20.

When the outer cap 54 is separated from the inner cap 20, each of the valve body 81, the opening/closing operation levers 82, and the opening/closing operation protrusions 83 return to their original positions by the elastic force accumulated in the valve body part 81, and the nozzle flow path 73*a* is opened (see FIGS. 11 and 12).

Next, when the discharge operation buttons 72 are pressurized, the cosmetics stored in the storage space 11*a* is supplied to the puff 52 through the neck part 12 and the nozzle flow path 73*a* (see FIG. 13), and when the pressing of the discharge operation buttons 72 is released, the operation of supplying the cosmetics to the puff 52 is interrupted.

In the meantime, when the outer cap 54 is coupled to the inner cap 20 after the use of the cosmetics, the pair of opening/closing operation protrusions 83 is pressurized in a direction in which they approach each other, so that the nozzle flow path 73*a* is closed.

Since the nozzle flow path 73*a* is closed when the outer cap 54 is coupled to the inner cap 20, even if the discharge operation buttons 72 are pressurized, the cosmetics stored in the storage space 11*a* may not be supplied to the puff 52.

According to the present invention, the nozzle opening/closing valve 80, which is operated such that the nozzle flow path 73*a* is closed when the outer cap 54 is coupled to the inner cap 20 and the nozzle flow path 73*a* is opened when the outer cap 54 is separated from the inner cap 20, is installed in the inner cap 20, and the discharge operation buttons 72 are formed in the circumferential region of the storage container body 11, so that it is possible to decrease the cosmetic discharge route between the nozzle 73 and the storage container body 11 and close the nozzle 73 during the non-discharge of the cosmetic.

Further, the longitudinal section of each opening/closing operation lever 82 is formed in a concave circular arc shape, so that the present invention may stably close the nozzle flow path 73*a* when the outer cap 54 is coupled to the inner cap 20.

Further, the nozzle 73 is provided with the pair of closed-loop shaped latching jaws 73*c* in the outside surface thereof, so that the opening/closing operation levers 82 may stably pressurize the lever-pressurized surface 73*b* in both directions.

What is claimed is:

1. A cosmetic receptacle comprising:

a storage container comprising a storage container body having a storage space therein and a pipe-shaped neck part formed in the storage container body such that the neck part is connected to the storage space;

an inner cap configured to comprise an inner cap body, through which an inner cap through-opening passes, and a closed-loop shaped inner cap circumferential wall extending from the inner cap body to surround the inner cap through-opening, and detachably coupled to the storage container through the inner cap body such that the inner cap through-opening is connected to the neck part;

a discharge operation part for discharging cosmetics stored in the storage space through a nozzle flow path with interworking with manipulation of discharge operation buttons, the discharge operation part comprising a nozzle provided with the nozzle flow path and installed such that the nozzle flow path is connected to the neck part and the discharge operation buttons manipulated by a user when the user desires to discharge the cosmetics stored in the storage space through the nozzle flow path;

an outer cap installed such that the outer cap surrounds the inner cap;

a shoulder part configured to comprise a support plate provided with a neck passage opening at a center thereof and a skirt part bent from a circumferential portion of the support plate and installed such that the neck part passes through the neck passage opening in a lower region of the inner cap and the shoulder part is supported on the storage container body through the support plate; and a concave auxiliary container comprising a pair of button openings having a phase difference of 180° and mounted to the storage container such that the auxiliary container surrounds the storage container body, wherein the inner cap circumferential wall has a pair of operation protrusion exposure openings having a phase difference of 180°, the nozzle is made of an elastic material, has a concave lever-pressurized surface in an outer surface of the nozzle to surround the nozzle flow path, and is installed in the inner cap through-opening such that the lever-pressurized surface faces the operation protrusion exposure opening, the discharge operation part comprises a nozzle opening/closing valve and a pair of press plates, the nozzle opening/closing valve comprising a ring-shaped valve body, a pair of opening/closing operation levers having a phase difference of 180° and extending from an inner surface of the valve body in a direction in which they approach each other, and a pair of opening/closing operation protrusions extending from an outside surface of the valve body at identical positions of the opening/closing operation levers in a direction in which they are away from each other, the nozzle opening/closing valve being installed in the inner cap such that the opening/closing operation protrusions protrude through the operation protrusion exposure opening, the valve body is deformed when the pair of opening/closing operation protrusions approach each other, and when the valve body is deformed, the pair of opening/closing operation levers press the lever-pressurized surface in both directions until the nozzle flow path is closed, the pair of press plates being formed from the skirt part to reach the button openings, the outer cap is coupled to the inner cap such that the pair of opening/closing operation protrusions protruding through the operation protrusion exposure openings is pressurized in a direction in which they approach each other, and the discharge operation buttons protrude from outer surfaces of the press plates such that the discharge operation buttons enter the button openings.

2. The cosmetic receptacle as claimed in claim 1, wherein each opening/closing operation lever has a longitudinal section shaped like a concave circular arc.

3. The cosmetic receptacle as claimed in claim 1, wherein the nozzle comprises a pair of latching jaws disposed in parallel in an outside surface of the nozzle with the lever-pressurized surface placed between the latching jaws and shaped like a closed-loop.

* * * * *